US009938841B2

(12) United States Patent
Stafford

(10) Patent No.: US 9,938,841 B2
(45) Date of Patent: Apr. 10, 2018

(54) DIAPHRAGM ASSEMBLY WITH A PRESWIRLER

(71) Applicant: SOLAR TURBINES INCORPORATED, San Diego, CA (US)

(72) Inventor: Scott L. Stafford, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 414 days.

(21) Appl. No.: 14/829,386

(22) Filed: Aug. 18, 2015

(65) Prior Publication Data

US 2016/0084095 A1 Mar. 24, 2016

Related U.S. Application Data

(60) Provisional application No. 62/052,389, filed on Sep. 18, 2014.

(51) Int. Cl.

| | |
|---|---|
| ***F01D 9/02*** | (2006.01) |
| ***F01D 9/04*** | (2006.01) |
| ***F01D 25/12*** | (2006.01) |
| ***F01D 25/24*** | (2006.01) |

(52) U.S. Cl.

CPC ..... *F01D 9/041* (2013.01); *F01D 25/12* (2013.01); *F01D 25/243* (2013.01); *F05D 2260/20* (2013.01)

(58) Field of Classification Search

CPC ..... F01D 9/041; F01D 25/12; F01D 25/243; F01D 5/08; F01D 5/081; F01D 5/082; F05D 2260/20

See application file for complete search history.

(56) References Cited

U.S. PATENT DOCUMENTS

| | | | | |
|---|---|---|---|---|
| 7,393,169 | B2 | 7/2008 | Süβenbach | |
| 7,494,362 | B2 | 2/2009 | Dieterle et al. | |
| 9,228,436 | B2 * | 1/2016 | Meyer | F01D 9/041 |
| 2002/0028136 | A1 | 3/2002 | Briesenick et al. | |
| 2008/0310951 | A1 | 12/2008 | Bremer | |
| 2011/0247347 | A1 | 10/2011 | Ebert et al. | |
| 2013/0098062 | A1 | 4/2013 | Donahoo et al. | |
| 2013/0149139 | A1 | 6/2013 | Jianxin et al. | |
| 2014/0010634 | A1 | 1/2014 | Meyer et al. | |

FOREIGN PATENT DOCUMENTS

| | | | |
|---|---|---|---|
| FR | 2761425 | A1 | 3/1997 |
| JP | 11325022 | A | 11/1999 |

* cited by examiner

*Primary Examiner* — Richard Edgar

(74) *Attorney, Agent, or Firm* — Procopio, Cory, Hargreaves & Savitch LLP

(57) ABSTRACT

A preswirler for a gas turbine engine diaphragm assembly is disclosed herein. In embodiments, the preswirler includes an outer ring and an inner ring. The outer ring includes an outer ring face, a first contact protrusion, and a second contact protrusion. The first and second contact protrusions are spaced apart and extend from an outer body portion at the outer ring face. The inner ring is located inward from the outer ring. The inner ring includes an inner ring face and a third contact protrusion. The third contact protrusion extends in from an inner body portion and at the inner ring face.

20 Claims, 4 Drawing Sheets

DIAPHRAGM ASSEMBLY WITH A PRESWIRLER

RELATED APPLICATIONS

The present application claims the benefit of U.S. Provisional Application No. 62/052,389 filed on Sep. 18, 2014 and titled Diaphragm Assembly with a Preswirler.

TECHNICAL FIELD

The present disclosure generally pertains to gas turbine engines, and is directed toward a diaphragm assembly including a preswirler.

BACKGROUND

Gas turbine engines include compressor, combustor, and turbine sections. Components of a gas turbine engine are subjected to high temperatures during operation, in particular, the components of the first stage of the turbine section. Some of these components are cooled by air directed through internal cooling passages from the compressor section. In one such passage, air may be directed through a diaphragm and into a preswirler fastened to the diaphragm. A loss in contact stress between the diaphragm and the preswirler may lead to uncontrolled loss or leakage of compressed air.

The present disclosure is directed toward overcoming one or more of the problems discovered by the inventors or that is known in the art.

SUMMARY OF THE DISCLOSURE

A preswirler for a gas turbine engine diaphragm assembly is disclosed herein. In embodiments, the preswirler includes an outer ring, an inner ring and a plurality of vanes. The outer ring includes an outer body portion, an outer swirling portion, a first contact protrusion, and as second contact protrusion. The outer body portion includes an outer ring face that includes a first annular shape. The outer swirling portion extends from the outer body portion opposite the outer ring face. The first contact protrusion extends in an axial direction relative to an axis of the preswirler from the outer body portion. The first contact protrusion is located radially inward of and adjacent to the outer ring face relative to the axis. The second contact protrusion extends in the axial direction from the outer body portion. The second contact protrusion is located radially outward of and adjacent to the outer ring face relative to the axis.

The inner ring is located inward from the outer ring relative to the axis forming a passage for cooling air therebetween. The inner ring includes an inner body portion, an inner swirling portion, and a third contact protrusion. The inner body portion includes an inner ring face that includes a second annular shape. The inner swirling portion extends from the inner body portion opposite the inner ring face. The third contact protrusion extends in the axial direction from the inner body portion. The third contact protrusion is located adjacent to the inner ring face. The plurality of vanes extends between the outer swirling portion and the inner swirling portion.

DETAILED DESCRIPTION

Figure 1:
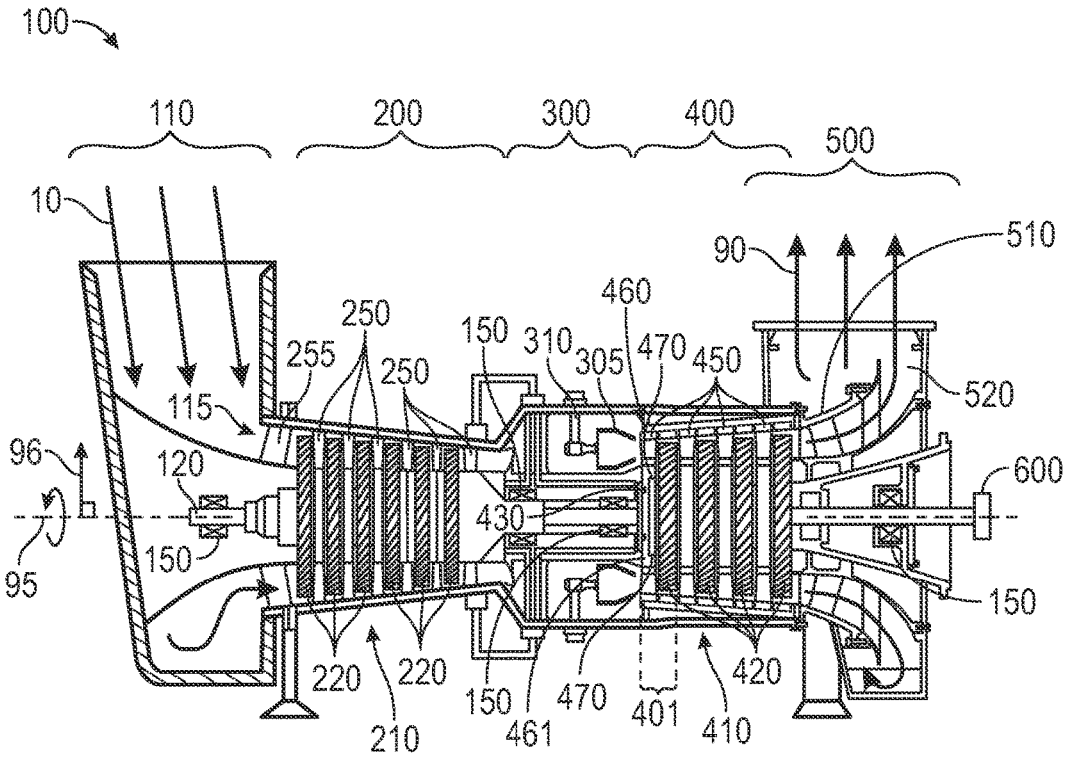
FIG. 1 is a schematic illustration of an exemplary gas turbine engine.

FIG. 1 is a schematic illustration of an exemplary gas turbine engine 100. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from center axis 95, wherein a radial 96 may be in any direction perpendicular and radiating outward from center axis 95.

A gas turbine engine 100 includes an inlet 110, a shaft 120, a compressor 200, a combustor 300, a turbine 400, an exhaust 500, and a power output coupling 600. The gas turbine engine 100 may have a single shaft or a dual shaft configuration.

The compressor 200 includes a compressor rotor assembly 210, compressor stationary vanes (stators) 250, and inlet guide vanes 255. The compressor rotor assembly 210 mechanically couples to shaft 120. As illustrated, the compressor rotor assembly 210 is an axial flow rotor assembly. The compressor rotor assembly 210 includes one or more compressor disk assemblies 220. Each compressor disk assembly 220 includes a compressor rotor disk that is circumferentially populated with compressor rotor blades. Stators 250 axially follow each of the compressor disk assemblies 220. Each compressor disk assembly 220 paired with the adjacent stators 250 that follow the compressor disk assembly 220 is considered a compressor stage. Compressor 200 includes multiple compressor stages. Inlet guide vanes 255 axially precede the compressor stages.

The combustor 300 includes one or more combustion chambers 305, one or more fuel injectors 310.

The turbine 400 includes a turbine rotor assembly 410 and turbine nozzle assemblies 450. The turbine rotor assembly 410 mechanically couples to the shaft 120. As illustrated, the turbine rotor assembly 410 is an axial flow rotor assembly. The turbine rotor assembly 410 includes one or more turbine disk assemblies 420. Each turbine disk assembly 420 includes a turbine disk 421 (shown in FIG. 2) that is circumferentially populated with turbine blades 425 (shown in FIG. 2). Turbine nozzle assemblies 450 may include turbine nozzles 455 and a turbine diaphragm assembly 460 supporting the turbine nozzles 455. A turbine nozzle assembly 450 may axially precede each of the turbine disk assemblies 420. Each turbine disk assembly 420 paired with the adjacent turbine nozzle assembly 450 that precedes the turbine disk assembly 420 is considered a turbine stage. The turbine first stage 401 may be the axially forward stage of turbine 400 adjacent combustor 300. Turbine 400 includes multiple turbine stages.

A turbine diaphragm assembly 460 may include a diaphragm 461 and a preswirler 470 coupled to the diaphragm 461. The coupling between the preswirler 470 and the diaphragm 461 may include spacers 430.

The exhaust 500 includes an exhaust diffuser 510 and an exhaust collector 520. The power output coupling 600 may be located at an end of shaft 120.

Figure 2:
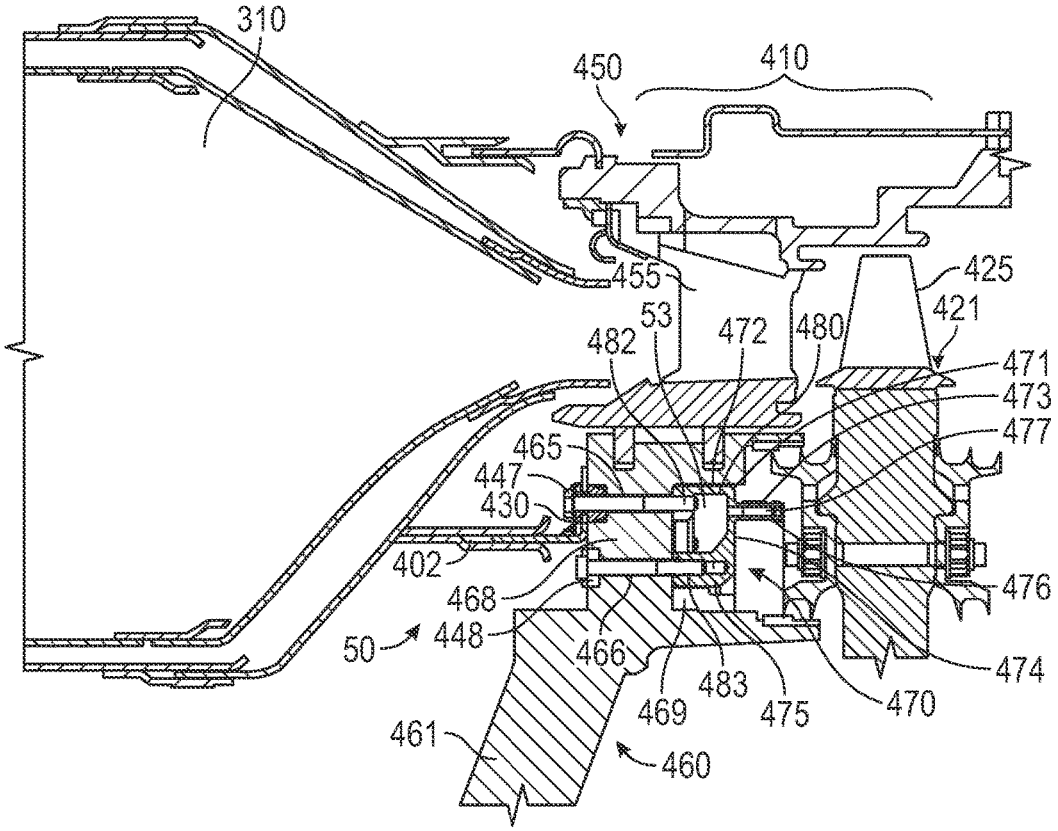
FIG. 2 is a cross-sectional view of a portion of the first stage of the turbine of FIG. 1.

FIG. 2 is a cross-sectional view of a portion of the first stage 401 of the turbine 400 of FIG. 1. The diaphragm 461 may generally be a solid of revolution configured to support turbine nozzles 455. The diaphragm 461 may include a mounting portion 468 with cooling holes or slots that extend axially through the mounting portion 468 that provide a pathway for compressed air to the preswirler 470. The mounting portion 468 includes a plurality of outer diameter holes 465. The outer diameter holes 465 extend axially through the mounting portion 468 and may be evenly spaced circumferentially about the axis of the diaphragm 461. The mounting portion 468 also includes a plurality of inner diameter holes 466. The inner diameter holes 466 are located radially inward from the outer diameter holes 465. The inner diameter holes 466 extend axially through the mounting portion 468 and may be evenly spaced circumferentially about the axis of the diaphragm 461. The mounting portion 468 may also include a cavity 469. Cavity 469 may be an annular cavity located in the aft side of mounting portion 468. The preswirler 470 may sit within the cavity 469 of the diaphragm 461 when mounted to the diaphragm 461.

The preswirler 470 may generally include an annular shape and may be press fit to the diaphragm and may be adjoining the mounting portion 468. The preswirler 470 may include an outer ring 471, an inner ring 474 defining a passage 53 for cooling air there between, and vanes 477. The outer ring 471 may include an outer body portion 472, an outer swirling portion 473, and first holes 482 (only one visible in FIG. 2). Outer swirling portion 473 may include a hollow cylinder shape. Outer swirling portion 473 may extend from outer body portion 472 in the axial direction and may be located aft of outer body portion 472. First holes 482 may be located in outer body portion 472 and may be threaded. First holes 482 are configured to receive the outer diameter couplers 447 for mounting the preswirler 470 to the diaphragm 461 and are configured to align with outer diameter holes 465. The outer ring 471 may include at least ten first holes 482.

The inner ring 474 may be located radially inward from outer ring 471. Inner ring 474 may include an inner body portion 475, an inner swirling portion 476, and second holes 483 (only one visible in FIG. 2). Inner body portion 475 may generally be axially aligned with and located radially inward from outer body portion 472. Inner swirling portion 476 may generally be axially aligned with and located radially inward from outer swirling portion 473. Inner swirling portion 476 may include a hollow cylinder shape. Inner swirling portion 476 may extend from inner body portion 475 in the axial direction and may be located aft of inner body portion 475. Second holes 483 may be located in inner body portion 475 and may be threaded. Second holes 483 are configured to receive the inner diameter couplers 448 for mounting the preswirler 470 to the diaphragm 461 and are configured to align with inner diameter holes 466. The inner ring 474 may include at least ten second holes 483.

Vanes 477 extend between outer ring 471 and inner ring 474. In the embodiment illustrated, vanes 477 extend between outer swirling portion 473 and inner swirling portion 476. Vanes 477 are generally angled to partially redirect air in a circumferential direction.

A spacer 430 may be located between the head of the each outer diameter coupler 447 and the diaphragm 461. The outer diameter couplers 447 and the spacers 430 may secure the inner turbine seal 402 to the diaphragm 461. In one embodiment the outer diameter couplers 447 and the inner diameter couplers 448 may be bolts. Alternative couplers such as rivets may also be used.

Figure 3:
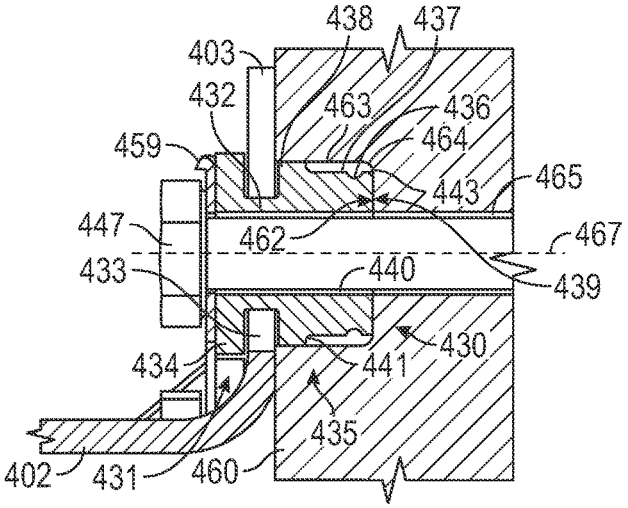
FIG. 3 is a detailed cross-sectional view of the coupling between the diaphragm and the preswirler of FIG. 2.

FIG. 3 is a detailed cross-sectional view of the coupling between the diaphragm 461 and the preswirler 470 of FIG. 2. Diaphragm 461 may include a counterbore 463 at each outer diameter hole 465. The counterbore 463 may be located opposite the cavity 469. Each counterbore 463 may include a counterbore surface 462 and a counterbore edge 464. Counterbore surface 462 may be an annular surface configured to contact the spacer 430. Counterbore edge 464 may be the radially outer edge of counterbore surface 462. Counterbore edge 464 may include an edge break, such as a fillet or chamfer.

A lock plate 459 may be located between an outer diameter coupler 447 and a spacer 430.

Figure 4:
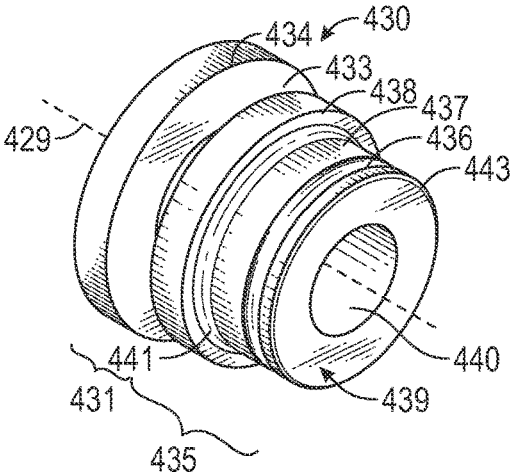
FIG. 4 is a perspective view of the spacer of FIG. 3.
Figure 5:
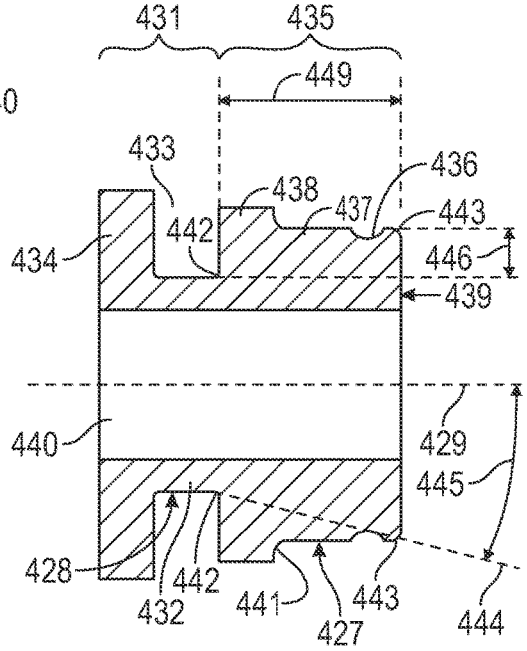
FIG. 5 is a cross-sectional view of the spacer of FIG. 4.

FIG. 4 is a perspective view of the spacer 430 of FIGS. 3. FIG. 5 is a cross-sectional view of the spacer 430 of FIG. 4. Referring to FIGS. 3-5, spacer 430 is a solid of revolution revolved about spacer axis 429 forming a spacer bore 440. In some embodiments, spacer 430 is forged of a single piece of material. In some embodiments, spacer 430 is machined from a single piece of material. All references to radial, axial, and circumferential directions and measures with regard to spacer 430 refer to spacer axis 429, and terms such as "inner" and "outer" generally indicate a lesser or greater radial distance from spacer axis 429, wherein a radial may be in any direction perpendicular and radiating outward from spacer axis 429. Spacer 430 includes a spacing portion 431 and a base 435. Spacing portion 431 and base 435 may share spacer axis 429 as a common axis. Spacer bore 440 extends through spacing portion 431 and base 435, and is coaxial to spacing portion 431 and base 435. Spacing portion 431 may generally be located outside of counterbore 463, while base 435 may generally be located within counterbore 463.

Spacing portion 431 may include a spacing body 432 and a spacing flange 434. Spacing body 432 may include a hollow cylinder shape. The diameter of spacing body 432 may be smaller than the diameter of base 435. Spacing body 432 may extend axially from base 435. Spacing body 432 may extend from an end opposite the contact surface 439 (described below) and in an axial direction away from the contact surface 439. Spacing body 432 may include a spacing body surface 428. Spacing body surface 428 may be a cylindrical surface and may be the radially outer surface of spacing body 432. Spacing flange 434 may extend radially outward from spacing body 432 and may be adjacent spacing body surface 428. Spacing flange 434 may be spaced apart from base 435 forming a gap 433 there between. Gap 433 may include an annular shape defined by the outer surface of spacing body 432 and annular surfaces of spacing flange 434 and base 435 that face each other.

Base 435 may include a base body 437, a base flange 438, and a groove 436. Base body 437 may include a hollow cylinder shape and may include a base body surface 427. Base body surface 427 may be the radially outer surface of base body 437 and may include a cylindrical shape. Base body 437 is contiguous to spacing body 432. Base body 437 may form a spacing body edge 442 with spacing body 432. Spacing body edge 442 may be located at an intersection of spacing body surface 428 and base body 437 and may be distal to spacing flange 434. Spacing body edge 442 may include an edge break, such as a fillet or chamfer. Base body 437 may include contact surface 439 and base edge 443. Contact surface 439 may be an annular surface of base body 437 located at an end of base body 437 opposite spacing body 432. Contact surface 439 is configured to contact counterbore surface 462 when spacer 430 is within the diaphragm assembly 460. Base edge 443 may be the radially outer edge of contact surface 439. Base edge 443 may include an edge break, such as a fillet or chamfer.

Base flange 438 extends radially outward from base body 437. Base flange 438 may be axially adjacent spacing body 432 and may form a base body edge 441 with base body 437. The diameter of base flange 438 may be the same or similar to the diameter of counterbore 463. Base flange 438 may be configured contact the counterbore 463 to locate spacer 430 within counterbore 463. Groove 436 may be formed in base body 437 and may extend annularly about base body 437. Groove 436 is an annular shape and may include a circular or rectangular cross-section. Groove 436 may also include one or more edge breaks. In the embodiment illustrated, groove 436 includes a circular cross-section where the depth of groove 436 is less than the radius of groove 436. Groove 436 may be proximal contact surface 439 and may be axially spaced apart from contact surface 439. Groove 436 may located at base body surface 427 and may extend into base body 435 from base body surface 427.

Referring to FIG. 5, base edge 443 is axially spaced apart from spacing body edge 442 at a base axial length 449, the axial length of base 435. Base edge 443 is also located outward from spacing body edge 442 at an edge differential 446, the radial distance between base edge 443 and spacing body edge 442. In some embodiments, the ratio of the base axial length 449 over the edge differential 446 is from 1.7 to 5.7. In other embodiments, the ratio of the base axial length 449 over the edge differential 446 is from 3 to 5. In yet other embodiments, the ratio of the base axial length 449 over the edge differential 446 is from 3.3 to 4.0. In still other embodiments, the ratio of the base axial length 449 over the edge differential 446 is within a predetermined tolerance of 3.66, such as plus or minus 0.25, 0.28, or 0.30.

In some embodiments, a reference line 444 extending from spacing body edge 442 to base edge 443 within a cross-sectional plane that includes spacer axis 429 forms a base edge angle 445 with spacer axis 429 from 10-30 degrees. In other embodiments, base edge angle 445 is from 12-19 degrees. In yet other embodiments, base edge angle 445 is from 10-20 degrees. In yet other embodiments, base edge angle 445 is from 12-19 degrees. In still other embodiments, base edge angle 445 is from 14-17 degrees. In still further embodiments, base edge angle 445 is within a predetermined tolerance of 15.3 degrees, such as 1 degree, 1.1 degrees, or 1.5 degrees.

Referring again to FIG. 3, inner turbine seal 402 may include a slip fit portion 403. The gap 433 may be configured to receive the inner turbine seal 402 via a slip fit at the slip fit portion 403.

Figure 6:
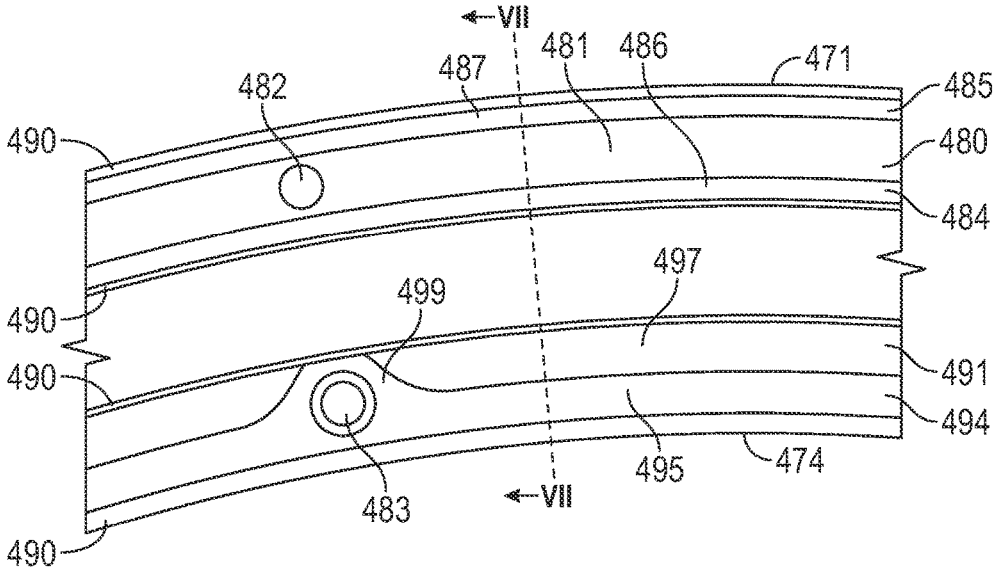
FIG. 6 is a plan view of a portion of the preswirler of FIG. 2 viewed from upstream of the preswirler.
Figure 7:
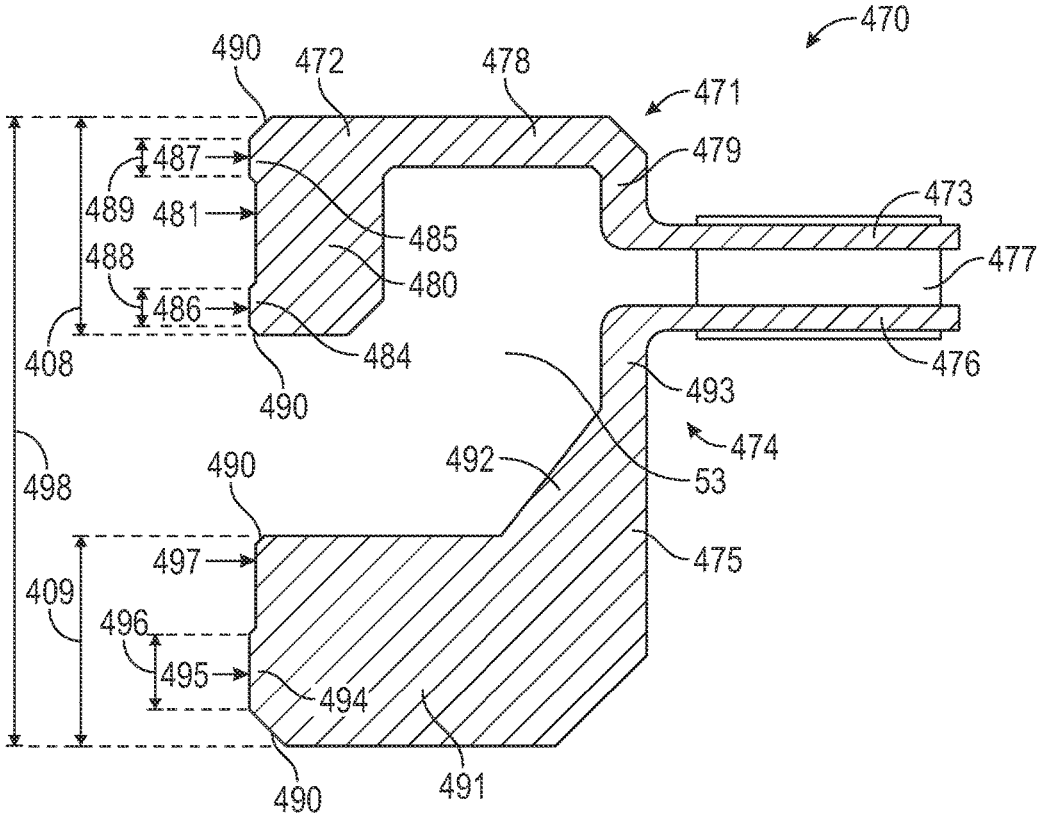
FIG. 7 is a cross-sectional view of the preswirler of FIG. 2 taken along the line VII-VII of FIG. 6.

FIG. 6 is a plan view of a portion of the preswirler of FIG. 2 viewed from upstream of the preswirler. FIG. 7 is a cross-sectional view of the preswirler of FIG. 2 taken along the line VII-VII of FIG. 6. Referring to FIGS. 6 and 7, outer body portion 472 may include an outer cylindrical portion 478, an outer back portion 479, and an outer flange portion 480. Outer cylindrical portion 478 may include a hollow cylinder shape. Outer back portion 479 may extend radially inward toward inner ring 474 from outer cylindrical portion 478. Outer swirling portion 473 may connect to outer body portion 472 at outer back portion 479 and may extend from the radially inner end of outer back portion 479. Outer flange portion 480 may also extend radially inward from outer cylindrical portion 478. Outer flange portion 480 may be distal to outer back portion 479. Outer flange portion 480 may include first holes 482 for securing preswirler 470 to diaphragm 461.

Inner body portion 475 may include an inner cylindrical portion 491 and an inner back portion 493. Inner cylindrical portion 491 may be located radially inward from outer cylindrical portion 478 and outer flange portion 480. Inner cylindrical portion 491 may include second holes 483 for securing preswirler 470 to diaphragm 461 Inner back portion 493 may extend radially outward toward outer ring 471 Inner back portion 493may be axially aligned with outer back portion 479. Inner back portion 493 may include an inner thickened portion 492 that is angled to direct air entering into passage 53 toward vanes 477.Inner swirling portion 476 may connect to inner body portion 475 at inner back portion 493 and may extend from the radially outer end of inner back portion 493.

Outer ring 471 may include an outer ring face 481, a first contact protrusion 484, and a second contact protrusion 485. Outer ring face 481 may be a surface facing axially forward and located on the outer body portion 472. In the embodiment illustrated, outer ring face 481 is located on the outer flange portion 480. Outer ring face 481 may include an annular shape.

First contact protrusion 484 may extend axially from outer body portion 472 at outer ring face 481. In the embodiment illustrated, first contact protrusion 484 extends from outer flange portion 480. First contact protrusion 484 may be adjacent outer ring face 481 and may be located radially inward from outer ring face 481. First contact protrusion 484 may include a first contact surface 486. First contact surface 486 is axially offset from outer ring face 481, such as being located axially forward of outer ring face 481 and is configured to contact diaphragm 461 when preswirler 470 is assembled within diaphragm assembly 460. First contact surface 486 may include an annular shape, such as an annulus. First contact surface 486 may include a first surface height 488, the radial height of first contact surface 486. The first surface height 488 is measured in the radial direction.

Second contact protrusion 485 may extend axially from outer body portion 472 at outer ring face 481. In the embodiment illustrated, second contact protrusion 485 extends from outer flange portion 480. Second contact protrusion 485 may be adjacent outer ring face 481 and may be located radially outward from outer ring face 481. Second contact protrusion 485 may include a second contact surface 487. Second contact surface 487 is axially offset from outer ring face 481, such as being located axially forward of outer ring face 481 and is configured to contact diaphragm 461 when preswirler 470 is assembled within diaphragm assembly 460. Second contact surface 487 may include an annular shape, such as an annulus. Second contact surface 487 may be parallel to and axially aligned with first contact surface 486. Second contact surface 487 may include a second surface height 489, the radial height of the second contact surface 487. The second surface height 486 is measured in the radial direction.

Inner ring 474 may include an inner ring face 497 and a third contact protrusion 494. Inner ring face 497 may be a surface facing axially forward and located on the inner body portion 475. Inner ring face 497 may include an annular shape.

Third contact protrusion 494 may extend axially from inner body portion 475 at inner ring face 497. In the embodiment illustrated, third contact protrusion 494 extends from inner cylindrical portion 491. Third contact protrusion 494 may be adjacent inner ring face 497 and may be located radially inward from inner ring face 497. Third contact protrusion 494 may include a third contact surface 495. Third contact surface 495 is axially offset from inner ring face 497, such as being located axially forward of inner ring face 497 and is configured to contact diaphragm 461 when preswirler 470 is assembled within diaphragm assembly 460. Third contact surface 495 may generally include an annular shape, such as an annulus. Third contact surface 495 may be parallel to and axially aligned with first contact surface 486 and second contact surface 487. Third contact surface 495 may include a third surface height 496, the radial height of third contact surface 495. The third surface height 496 is measured in the radial direction.

Third contact protrusion 494 may also include an inner bolt protrusion 499. An inner bolt protrusion 499 may be located at second hole 483 and may extend around the perimeter of second hole 483. Third contact surface 495 may extend radially outward from the annular shape and around second hole 483 at the location of inner bolt protrusion 499.

Preswirler 470 may include a preswirler height 498. The preswirler height 498 may be the overall radial height of preswirler 470 at the face preswirler 470. Outer ring 471 may include an outer ring height 408. Outer ring height 408 may be the radial height over outer ring 471 at the face of preswirler 470. In the embodiment illustrated, outer ring height 408 includes the combined radial heights of outer cylindrical portion 478 and outer flange portion 480 Inner ring 474 may include an inner ring height 409. Inner ring height 409 may be the radial height of inner ring 474 at the face of preswirler 470. In the embodiment illustrated, inner ring height 409 includes the radial height of inner cylindrical portion 491. The preswirler height 498, the outer ring height 408, and the inner ring height 409 are measured in the radial direction.

In some embodiments, a first contact ratio of the outer ring height 408 over the combined heights of the first surface height 488 and second surface height 489 is from 2.5 to 2.9. In other embodiments the first contact ratio is from 2.6 to 2.8.

In some embodiments, a second contact ratio of the inner ring height 409 over the third surface height 496 is from 2.5 to 2.9. In other embodiments, the second contact ration is from 2.6 to 2.8.

In some embodiments, an overall contact ratio of the preswirler height 498 over the combined heights of first surface height 488, second surface height 489, and third surface height 496 is from 3.75 to 4.25. In other embodiments, the overall contact ratio is from 3.9 to 4.2.

One or more of the above components (or their subcomponents) may be made from cast iron, stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, alloy x, INCONEL, WASPALOY, RENE alloys, HAYNES alloys, alloy 188, alloy 230, INCOLOY, MP98T, TMS alloys, and CMSX single crystal alloys. In some embodiments, diaphragms 461 are cast iron and spacers 430 are Inconel 718.

INDUSTRIAL APPLICABILITY

Gas turbine engines may be suited for any number of industrial applications such as various aspects of the oil and gas industry (including transmission, gathering, storage, withdrawal, and lifting of oil and natural gas), the power generation industry, cogeneration, aerospace, and other transportation industries.

Referring to FIG. 1, a gas (typically air 10) enters the inlet 110 as a "working fluid", and is compressed by the compressor 200. In the compressor 200, the working fluid is compressed in an annular flow path 115 by the series of compressor disk assemblies 220. In particular, the air 10 is compressed in numbered "stages", the stages being associated with each compressor disk assembly 220. For example, "4th stage air" may be associated with the 4th compressor disk assembly 220 in the downstream or "aft" direction, going from the inlet 110 towards the exhaust 500). Likewise, each turbine disk assembly 420 may be associated with a numbered stage.

Once compressed air 10 leaves the compressor 200, it enters the combustor 300, where it is diffused and fuel is added. Air 10 and fuel are injected into the combustion chamber 305 via fuel injector 310 and combusted. Energy is extracted from the combustion reaction via the turbine 400 by each stage of the series of turbine disk assemblies 420. Exhaust gas 90 may then be diffused in exhaust diffuser 510, collected and redirected. Exhaust gas 90 exits the system via an exhaust collector 520 and may be further processed (e.g., to reduce harmful emissions, and/or to recover heat from the exhaust gas 90).

Operating efficiency of a gas turbine engine generally increases with a higher combustion temperature. Thus, there is a trend in gas turbine engines to increase the temperatures. Gas reaching a turbine first stage 401 from a combustion chamber 305 may be 1000 degrees Fahrenheit or more. To operate at such high temperatures a portion of the compressed air of the compressor 200 of the gas turbine engine 100 may be diverted through internal passages or chambers to cool the turbine blades 425 in the turbine first stage 401.

The gas reaching the turbine blades 425 in the turbine first stage 401 may also be under high pressure. The cooling air diverted from the compressor 200 may need to be at compressor discharge pressure to effectively cool turbine blades 425 in the turbine first stage 401. Gas turbine engine 100 components containing the internal passages for the cooling air such as a diaphragm 461 and a preswirler 470 may be subject to elevated levels of stress.

Cooling air with a substantially axial flow is diverted from the compressor discharge to a path for cooling air 50. The cooling air passes through the diaphragm 461 and into passage 53 of the preswirler 470. The cooling air redirected to include a tangential component by vanes 477 and into the turbine disk assembly 420. The cooling air may be redirected such that the tangential component of the cooling air matches the angular velocity of the turbine disk assembly 420.

Matching the angular velocity of the turbine disk assembly 420 may prevent an increase in the velocity of the cooling air. An increase in velocity of the cooling air would result in an increase in temperature and a pressure drop in the cooling air, which may reduce the effectiveness of the cooling air in cooling turbine blades 425. An increase in velocity of the cooling air may also result in a loss in efficiency due to the work imparted by the turbine disk 421 on the cooling air. Once the cooling air passes into the turbine disk assembly, the cooling air cools the turbine disk assembly including the turbine blades 425. The described arrangement may also be used in other stages.

The couplers, such as fasteners, that couple a preswirler to a diaphragm may lose tension due to high bearing loads and yielding of the various clamped components. This yielding may be caused by the temperature increase, pressure increase, and forces on the clamped components resulting from the cooling air entering the diaphragm and preswirler. The loss in tension may permit a leakage of cooling air causing a loss of efficiency in the gas turbine engine.

A diaphragm assembly 460 coupled together using outer diameter couplers 447 with spacers 430 and inner diameter couplers 448 to couple preswirler 470 to diaphragm 461 may form a more rigid connection and may reduce stress on the various components. The contact surfaces 439 of spacers 430 may contact counterbore surfaces 462 over a larger surface area, which may reduce the contact stress between spacers 430 and diaphragm 461 and may prevent diaphragm 461 from yielding at counterbore surface 462.

Spacers 430 that are configured with gap 433 may better distribute the contact stresses between contact surface 439 and diaphragm 461 when the ratio of the base axial length 449 over the edge differential 446 is within the ratios provided herein and/or when the base edge angle 445 is within the ranges provided herein. Better distributing the contact stresses across contact surface 439 may further prevent diaphragm 461 from yielding and may reduce stresses within spacers 430.

Providing spacers 430 with a groove 436 may reduce the rigidity of base body 437 at and around base edge 443 and may prevent or reduce the formation of Hertzian stresses at base edge 443.

Base flange 438 may contact counterbore 463 to locate spacer 430 within counterbore 463. Base flange 438 may create a radial offset between counterbore edge 464 and base edge 443. Counterbore edge 464 may include a fillet. The radial offset may ensure that there is not interference between counterbore edge 464 including the fillet and base edge 443 and that base edge 443 contacts the counterbore surface 462 at a location that is offset from the counterbore edge 464.

The connection including outer diameter couplers 447 and inner diameter couplers 448 may also prevent deformation of the preswirler 470. Providing a preswirler 470 with first contact protrusion 484, second contact protrusion 485, and third contact protrusion 494 along with their surfaces first contact surface 486, second contact surface 487 and third contact surface 495 may increase the contact stress between the surfaces of preswirler 470 and the surface of the diaphragm 461 that are in contact providing an improved seal. An improved seal between the preswirler 470 and the diaphragm 461 may prevent cooling air from leaking and may improve the overall efficiency of the gas turbine engine 100.

The preceding detailed description is merely exemplary in nature and is not intended to limit the invention or the application and uses of the invention. The described embodiments are not limited to use in conjunction with a particular type of gas turbine engine. Hence, although the present disclosure, for convenience of explanation, depicts and describes a particular diaphragm assembly, it will be appreciated that the diaphragm assembly in accordance with this disclosure can be implemented in various other configurations, can be used with various other types of gas turbine engines, and can be used in other types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. A preswirler for a gas turbine engine diaphragm assembly, the preswirler comprising:

an outer ring including an outer body portion including an outer ring face, the outer ring face including a first annular shape, an outer swirling portion extending from the outer body portion opposite the outer ring face, a first contact protrusion extending from the outer body portion at the outer ring face, and a second contact protrusion extending from the outer body portion at the outer ring face, the second contact protrusion being spaced apart from the first contact protrusion;

an inner ring located inward from the outer ring and forming a passage for cooling air therebetween, the inner ring including an inner body portion including an inner ring face, the inner ring face including a second annular shape, an inner swirling portion extending from the inner body portion opposite the inner ring face, and a third contact protrusion extending from the inner body portion at the inner ring face; and a plurality of vanes extending between the outer swirling portion and the inner swirling portion.

2. The preswirler of claim 1, wherein the third contact protrusion is located inward relative to an axis of the inner ring.

3. The preswirler of claim 1, wherein the first contact protrusion includes a first contact surface, the second contact protrusion includes a second contact surface, and the third contact protrusion includes a third contact surface, and wherein the first contact surface, the second contact surface, and the third contact surface are axially aligned relative to an axis of the outer ring and each includes a shape of an annulus.

4. The preswirler of claim 3, wherein the first contact surface includes a first surface height measured in the radial direction, the second contact surface includes a second surface height measured in the radial direction and the outer body portion includes an outer ring height measured in the radial direction, and wherein a ratio of the outer ring height over a combined height of the first surface height and second surface height is from 2.5 to 2.9.

5. The preswirler of claim 3, wherein the third contact surface includes a third surface height measured in the radial direction and the inner body portion includes an inner ring height measured in the radial direction, and wherein a ratio of the inner ring height over the third surface height is from 2.5 to 2.9.

6. The preswirler of claim 3, wherein the first contact surface includes a first surface height measured in the radial direction, the second contact surface includes a second surface height measured in the radial direction, the third contact surface includes a third surface height measured in the radial direction and the preswirler includes a preswirler height measured in the radial direction, and wherein a ratio of the preswirler height over a combined height of the first surface height, second surface height, and the third surface height is from 3.75 to 4.25.

7. The preswirler of claim 1, wherein the outer ring includes a plurality of first holes extending into the outer body portion through the outer ring face for securing the preswirler to a diaphragm of the diaphragm assembly and the inner ring includes a plurality of second holes extending into the inner body portion, and wherein the third contact protrusion includes an inner bolt protrusion extending around each second hole of the plurality of second holes.

8. A preswirler for a gas turbine engine diaphragm assembly, the preswirler comprising:

an outer ring including an outer body portion including an outer ring face, the outer ring face including a first annular shape, an outer swirling portion extending from the outer body portion opposite the outer ring face, a first contact surface located radially inward of and adjacent to the outer ring face relative to an axis of the outer ring, the first contact surface being axially offset from the outer ring face in an axial direction away from the outer swirling portion, and a second contact surface located radially outward of and adjacent to the outer ring face relative to the axis, the second contact surface being axially offset from the outer ring face in the axial direction;

an inner ring located inward from the outer ring relative to the axis and forming a passage for cooling air therebetween, the inner ring including an inner body portion including an inner ring face, the inner ring face including a second annular shape, an inner swirling portion extending from the inner body portion opposite the inner ring face, and a third contact surface located adjacent to the inner ring face, the third contact surface being axially offset from the inner ring face in the axial direction; and a plurality of vanes extending between the outer swirling portion and the inner swirling portion.

9. The preswirler of claim 8, wherein the third contact surface is located radially inward from the inner ring face.

10. The preswirler of claim 8, wherein the first contact surface includes a first surface height measured in the radial direction, the second contact surface includes a second surface height measured in the radial direction and the outer body portion includes an outer ring height measured in the radial direction, and wherein a ratio of the outer ring height over a combined height of the first surface height and second surface height is from 2.5 to 2.9.

11. The preswirler of claim 8, wherein the third contact surface includes a third surface height measured in the radial direction and the inner body portion includes an inner ring height measured in the radial direction, and wherein a ratio of the inner ring height over the third surface height is from 2.5 to 2.9.

12. The preswirler of claim 8, wherein the first contact surface includes a first surface height measured in the radial direction, the second contact surface includes a second surface height measured in the radial direction, the third contact surface includes a third surface height measured in the radial direction and the preswirler includes a preswirler height measured in the radial direction, and wherein a ratio of the preswirler height over a combined height of the first surface height, second surface height, and the third surface height is from 3.75 to 4.25.

13. The preswirler of claim 8, wherein the first contact surface, the second contact surface, and the third contact surface are axially aligned direction relative to the axis.

14. The preswirler of claim 8, wherein the first contact surface, the second contact surface, and the third contact surface each includes a shape of an annulus.

15. A diaphragm assembly for a gas turbine engine, the diaphragm assembly comprising:

a diaphragm including a mounting portion;

a preswirler adjoining the mounting portion on a side of the mounting portion opposite the counterbore, the preswirler including an outer ring including an outer body portion including an outer ring face, the outer ring face including a first annular shape, an outer swirling portion extending from the outer body portion away from the mounting portion, a first contact surface located radially inward of and adjacent to the outer ring face relative to an axis of the outer ring, the first contact surface being axially offset from the outer ring face and in contact with the mounting portion, and a second contact surface located radially outward of and adjacent to the outer ring face relative to the axis, the second contact surface being axially offset from the outer ring face and in contact with the mounting portion a first hole extending into the outer body portion through the outer ring face;

an inner ring located inward from the outer ring relative to the axis and forming a passage for cooling air therebetween, the inner ring including an inner body portion including an inner ring face, the inner ring face including a second annular shape, an inner swirling portion extending from the inner body portion away from the mounting portion, and a third contact surface located adjacent to the inner ring face, the third contact surface being axially offset from the inner ring face and in contact with the mounting portion; and a plurality of vanes extending between the outer swirling portion and the inner swirling portion; and an outer diameter coupler that secures the preswirler to the diaphragm.

16. The diaphragm assembly of claim 15, wherein the diaphragm includes a counterbore located in the mounting portion, the counterbore including a counterbore surface and a counterbore edge being the radially outer edge of the counterbore surface, the diaphragm assembly further comprising:

a spacer including a base including a base body at least partially located within the counterbore, the base body including a first hollow cylinder shape with a first outer diameter relative to a spacer axis, a base flange extending radially outward from the base body, the base flange contacting the counterbore to locate the spacer within the counterbore, a contact surface at an end of the base body, the contact surface being in contact with the counterbore surface, and a base edge being a radially outer edge of the contact surface, a spacing portion including a spacing body at least partially located outside of the counterbore, the spacing body extending axially about the spacer axis from the base from an end opposite the contact surface and in an axial direction away from the contact surface, the spacing body including a second hollow cylinder shape with a second outer diameter that is smaller than the first outer diameter, and a spacing flange extending radially outward from the spacing body and spaced apart from the base forming a gap configured to receive a slip fit portion of an inner turbine seal of the gas turbine engine, and a spacing body edge located at an intersection of the spacing body and the base body; and wherein the outer diameter coupler extends through the spacer and the diaphragm and into the first hole to secure the preswirler to the diaphragm.

17. The diaphragm assembly of claim 15, wherein the outer ring further comprises a first contact protrusion extending in the axial direction from the outer body portion, the first contact protrusion including the first contact surface and a second contact protrusion extending in the axial direction from the outer body portion, the second contact protrusion including the second contact surface; and wherein the inner ring further comprises a third contact protrusion extending in the axial direction from the inner body portion, the third contact protrusion including the third contact surface.

18. The diaphragm assembly of claim 15, wherein the first contact surface includes a first surface height measured in the radial direction, the second contact surface includes a second surface height measured in the radial direction and the outer body portion includes an outer ring height measured in the radial direction, and wherein a contact ratio of the outer ring height over a combined height of the first surface height and second surface height is from 2.5 to 2.9.

19. The diaphragm assembly of claim 15, wherein the third contact surface includes a third surface height measured in the radial direction and the inner body portion includes an inner ring height measured in the radial direction, and wherein a contact ratio of the inner ring height over the third surface height is from 2.5 to 2.9.

20. The diaphragm assembly of claim 15, wherein the first contact surface includes a first surface height measured in the radial direction, the second contact surface includes a second surface height measured in the radial direction, the third contact surface includes a third surface height measured in the radial direction and the preswirler includes a preswirler height measured in the radial direction, and wherein a ratio of the preswirler height over a combined height of the first surface height, second surface height, and the third surface height is from 3.75 to 4.25.

* * * * *